US007316388B2

(12) United States Patent
Prismall

(10) Patent No.: US 7,316,388 B2
(45) Date of Patent: Jan. 8, 2008

(54) CONNECTOR AND WEBBING ARRANGEMENT

(75) Inventor: Ian James Prismall, Hungerford (GB)

(73) Assignee: Primac Limited, Hungerford (GB)

( * ) Notice: Subject to any disclaimer, the term of this patent is extended or adjusted under 35 U.S.C. 154(b) by 170 days.

(21) Appl. No.: 11/036,717

(22) Filed: Jan. 14, 2005

(65) Prior Publication Data

US 2005/0139710 A1 Jun. 30, 2005

(51) Int. Cl.
*E04H 17/02* (2006.01)

(52) U.S. Cl. ..... 256/43; 256/39; 256/40; 256/44; 256/45; 160/24; 160/120

(58) Field of Classification Search ..... 160/24, 160/120, 122, 241, 383, 399, 402; 256/24, 256/39, 40, 43, 44, 45; 403/364; 24/31 H, 24/33 P, 33 R; 242/376, 402
See application file for complete search history.

(56) References Cited

U.S. PATENT DOCUMENTS

| | | | | |
|---|---|---|---|---|
| 328,822 | A | 10/1885 | Spruce | |
| 457,012 | A | 8/1891 | Roberts | |
| 1,975,862 | A | 10/1934 | Olsen | |
| 2,145,455 | A * | 1/1939 | Olsen | 24/33 P |
| 2,152,816 | A * | 4/1939 | Olson | 256/24 |
| 2,176,617 | A | 10/1939 | Webster | |
| 3,643,923 | A * | 2/1972 | Kirchhoff, Jr. | 256/25 |
| 5,050,846 | A | 9/1991 | Goodman et al. | |
| 5,718,414 | A * | 2/1998 | Deloach et al. | 256/24 |
| 5,758,868 | A * | 6/1998 | Shea | 256/24 |
| 6,247,427 | B1 * | 6/2001 | DeBien | 119/776 |
| 6,904,720 | B1 * | 6/2005 | Adolfson et al. | 160/399 |

FOREIGN PATENT DOCUMENTS

| | | |
|---|---|---|
| CH | 389004 | 3/1965 |
| EP | 0287510 | 10/1988 |
| EP | 0352071 | 1/1990 |

* cited by examiner

*Primary Examiner*—Gregory J. Binda
*Assistant Examiner*—Michael P. Ferguson
(74) *Attorney, Agent, or Firm*—Skinner & Associates

(57) ABSTRACT

A webbing connector comprises first and second inter-engageable components (44, 46) and connecting means (58) co-operable with the components (44, 46) to secure the components (44, 46) to one another. The connecting means may comprise a connecting pin.

8 Claims, 3 Drawing Sheets

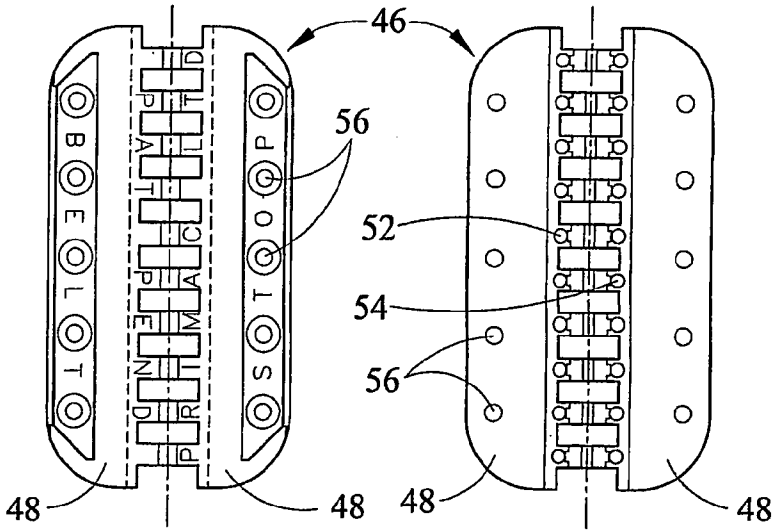
FIG 9
FIG 8
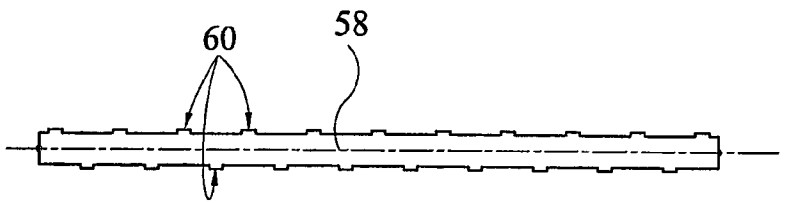
FIG 10
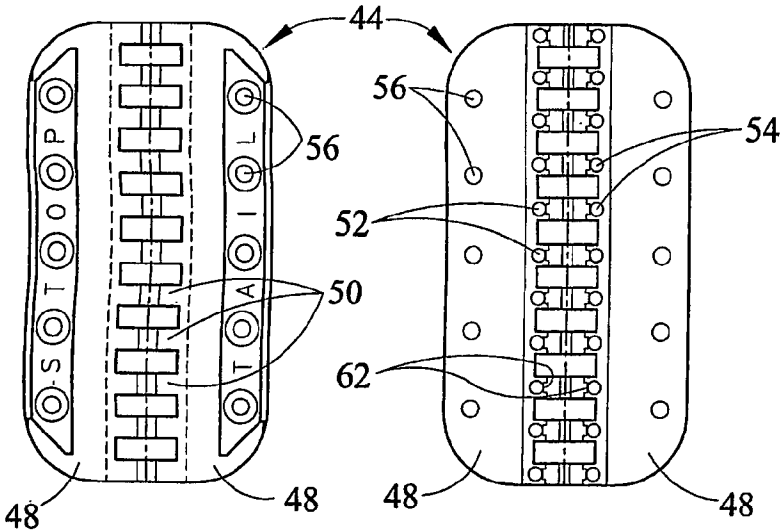
FIG 7
FIG 6
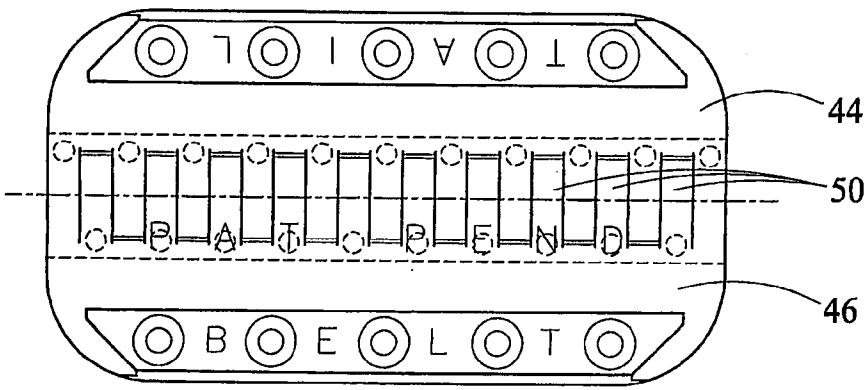
FIG 11

CONNECTOR AND WEBBING ARRANGEMENT

CROSS-REFERENCE TO RELATED APPLICATIONS, IF ANY

Not applicable.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND

1. Field

This invention relates to a connector suitable for use in a webbing arrangement, for example suitable for use in a retractable barrier. Although suitable for use in a retractable barrier, the connector and the webbing arrangement may also be suitable for use in a number of other applications, for example in seat belts, for example for use in vehicles or in load or ratchet straps.

2. Background Information

Retractable barriers are used in a number of applications in which it is desired, sometimes, to provide a barrier. By way of example, retractable barriers are often used in supermarkets to prevent the passage of customers or shopping trolleys past check-outs which are not in use. They are also sometimes used to define passageways for the purposes of queue management.

This invention relates to a connector suitable for use in a webbing arrangement, for example suitable for use in a retractable barrier. Although suitable for use in a retractable barrier, the connector and the webbing arrangement may also be suitable for use in a number of other applications, for example in seat belts, for example for use in vehicles or in load or ratchet straps.

Retractable barriers are used in a number of applications in which it is desired, sometimes, to provide a barrier. By way of example, retractable barriers are often used in supermarkets to prevent the passage of customers or shopping trolleys past check-outs which are not in use. They are also sometimes used to define passageways for the purposes of queue management.

Typically, a retractable barrier comprises a housing containing a spool upon which a length of webbing is wound. A free end of the webbing is provided with part of a catch mechanism, for example part of a magnetic catch. A spring is provided within the housing to bias the spool towards a position in which the webbing is wound onto the spool.

In use, the housing is mounted in a suitable position, for example at a check-out, or on a pole. When the barrier is to be used, the free end of the webbing is pulled to remove a length of the webbing from the housing causing the spool to rotate against the action of the spring biassing, and the part of the catch mechanism carried by the webbing is secured to the remainder of the catch mechanism which is mounted, for example, on part of an adjacent check-out or on another pole. The spring biassing of the spool applies a sufficient tension to the webbing to hold the webbing tight, and to ensure that upon release of the catch mechanism the webbing is retracted into the housing.

Once a barrier of this type has been installed for some time, the webbing thereof may become marked or begin to look worn. In order to replace the webbing, the housing must be removed and opened, the webbing removed from the spool and a new length of webbing introduced. This is a complex and time-consuming operation. In some applications, the webbing carries markings, for example printed messages or logos. If it is desired to replace the markings or logos then, again, the housing must be removed and dismantled.

BRIEF SUMMARY OF THE INVENTION

According to one aspect of the invention there is provided a webbing arrangement comprising a first length of webbing, and a second length of webbing connected to the first length of webbing.

According to one aspect of the invention there is provided a webbing arrangement comprising a first length of webbing, and a second length of webbing connected to the first length of webbing.

The lengths of webbing may be connected to one another by a semi-permanent connection. Preferably, however, a releasable, re-securable fastening is provided to secure the first and second lengths of webbing to one another. The releasable, re-securable fastening may comprise, for example press-studs/poppers, zips, velcro, hooks and eyes, buckles, pins, clamps, screws, nuts and bolts, etc. One particularly suitable fastener device comprises first and second inter-engageable components secured, respectively, to the first and second lengths of webbing, and a connecting pin to secure the first and second components to one another.

The webbing arrangement may be used in, for example, a retractable barrier, a seat belt or a luggage, cargo or ratchet strap.

According to another aspect of the present invention there is provided a retractable barrier comprising a housing, a spring biassed spool rotatable within the housing, a length of webbing, and a flexible connection member to which the length of webbing is connected thereby connecting the length of webbing to the spool, the flexible connection member being of sufficient length that when the webbing is fully unwound from the spool, the connection between the flexible connection member and the webbing is located outside of the housing.

It will be appreciated that replacement of the webbing can be undertaken without removing and dismantling the housing, and hence replacement of the webbing is simplified.

The flexible connection member conveniently comprises a second length of webbing.

The connection between the connection member and the length of webbing may be of semi-permanent nature, for example the connection member and the length of webbing may be secured to one another using adhesive, rivets, tape, sewing or staples. Preferably, however, a releasable, re-securable fastening may be used. It will be appreciated that a wide range of fastenings could be used, for example press-studs/poppers, zips, velcro, hooks and eyes, buckles, pins, clamps, screws, nuts and bolts, etc. One particularly suitable fastener device comprises first and second inter-engageable components secured, respectively, to the length of webbing and the connection member, and a connecting pin to secure the first and second components to one another.

According to another aspect of the invention there is provided a connector comprising first and second inter-engageable components securable, in use, to a connection member and a length of webbing, respectively, and a connecting pin co-operable with the first and second inter-engageable components to secure the inter-entageable components to one another.

The first and second inter-engageable components each conveniently define a plurality of spaced teeth, at least some of the teeth of one of the components being receivable between at least some of the teeth of the other of the components. The teeth conveniently define a passage, in use, within which the connecting pin is receivable. A detent arrangement is conveniently provided to resist removal of the connecting pin. The detent arrangement may comprise a series of small projections provided on the connecting pin and receivable, in use, in corresponding recesses provided in the first and/or second inter-engageable components.

BRIEF DESCRIPTION OF SEVERAL VIEWS OF THE DRAWINGS

The invention will further be described, by way of example, with reference to the accompanying drawings, in which:

The invention will further be described, by way of example, with reference to the accompanying drawings, in which:

FIGS. 6 and 7 are front and rear views of one component of a connector;

FIGS. 8 and 9 are front and rear views of another component of the connector;

FIG. 10 is a view of a third component of the connector; and

FIG. 11 is a view of the connector of FIGS. 6 to 10 in assembled form.

DETAILED DESCRIPTION OF THE INVENTION

Figure 1:
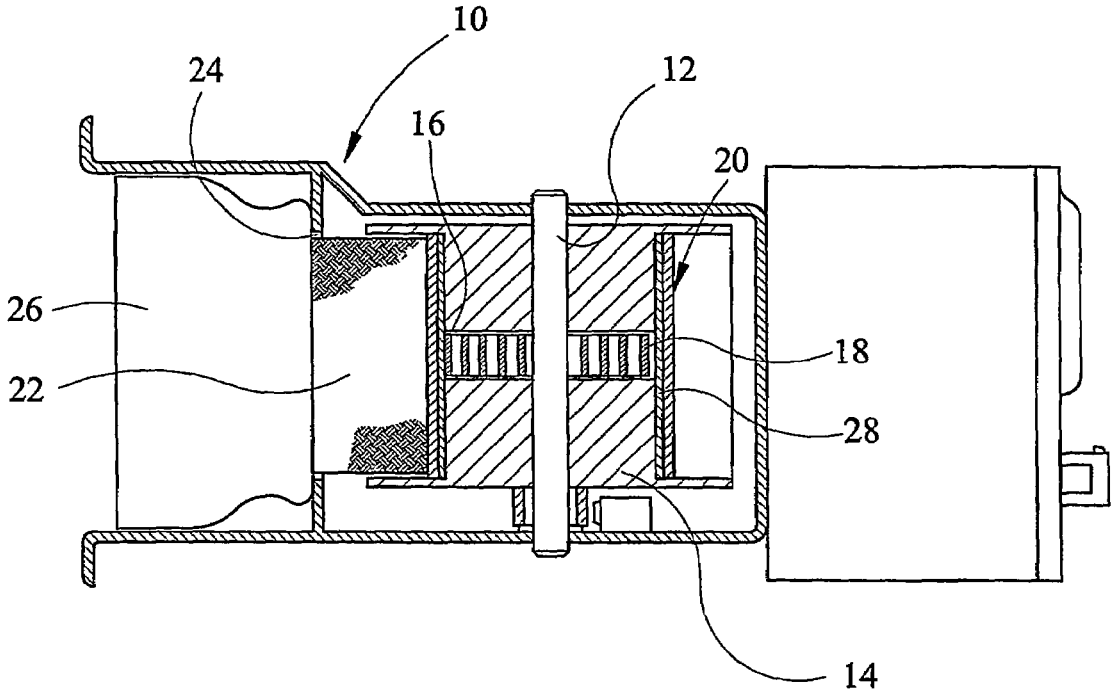
FIGS. 1 and 2 are sectional views illustrating a retractable barrier in accordance with an embodiment of the invention.
Figure 2:
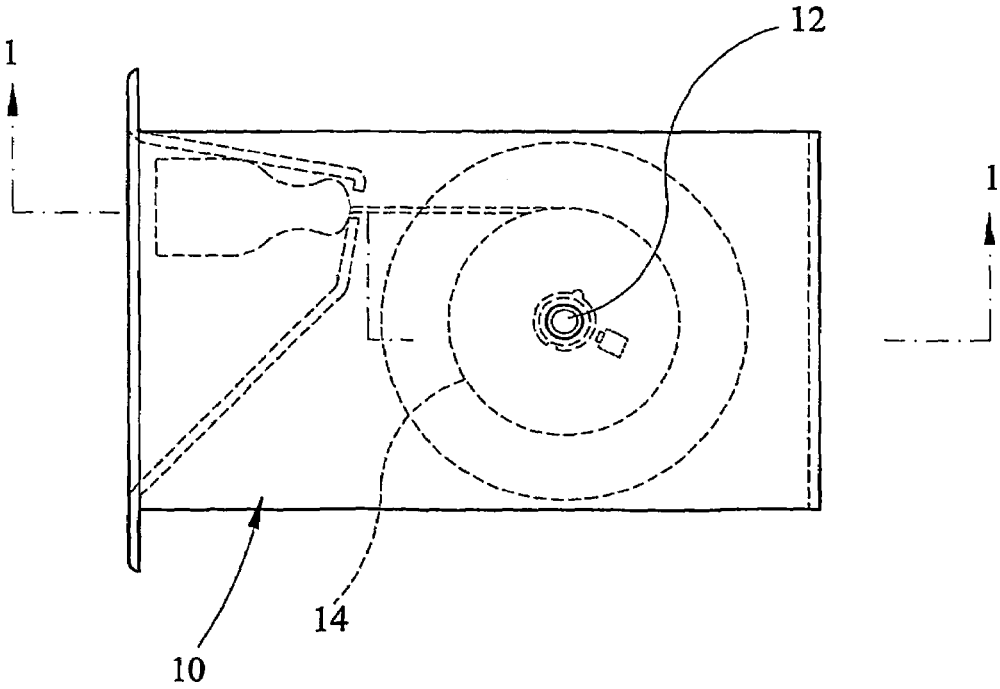

Referring firstly to FIGS. 1 and 2, a retractable barrier is shown which comprises a housing 10, typically of steel or plastics construction, within which a spindle 12 is mounted. A spool 14 is rotatably mounted upon the spindle 12. The spool 14 is of moulded plastics form and defines a cavity 16 within which a coiled spring 18 is located, one end of the spring 18 being secured to the spindle 12 and the other end to the spool 14.

A length of webbing 20 is wound upon the spool 14, the length of webbing 20 having a free end 22 which projects through a slot 24 provided in the housing 10 and to which a magnetic part 26 of a magnetic catch is secured. Although a magnetic catch is shown, it will be appreciated that a number of other devices could be used.

The end of the length of webbing 20 opposite the free end 22 is not secured directly to the spool 14 but rather is attached to a flexible connection member in the form of a second length of webbing 28 which, in turn, is secured to the spool 14. The second length of webbing 28 is of length sufficient to permit the connection between the lengths of webbing 20, 28 to pass through the slot 24 and out of the housing 10.

The second length of webbing 28 is secured to the spool 14 using any suitable technique, for example by means of adhesive, by clamping, rivetting, etc.

The first and second lengths of webbing 20, 28 may be secured to one another by a range of techniques. For example, they may be sewn to one another, adhered to one another using a suitable adhesive, stapled or rivetted to one another. It will be appreciated that these fastening techniques are all of a semi-permanent nature and hence that a significant amount of work may be needed if it is desired to remove and replace the first length of webbing 20. However, the task is simplified compared to existing arrangements as there is no longer the need to disassemble the housing, unlike existing devices.

Rather than use a semi-permanent connection, a releasible fastening may be used.

Examples of suitable releasable fasteners include zips, hooks and eyes, press studs/poppers, velcro, clamping devices, buckles or the like. One preferred fastening is shown in FIGS. 3 to 5.

Figure 3:
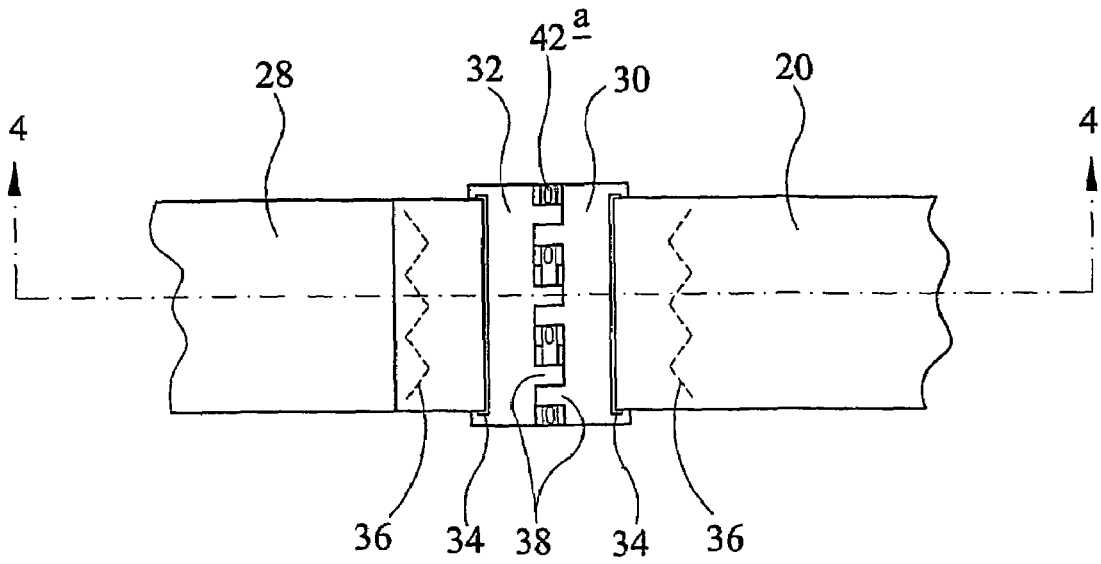
FIG. 3 is a view of part of the barrier.
Figure 4:
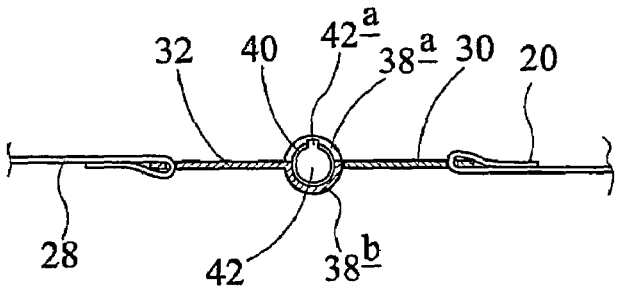
FIG. 4 is a sectional view along the Line 4-4 of FIG. 3.
Figure 5:
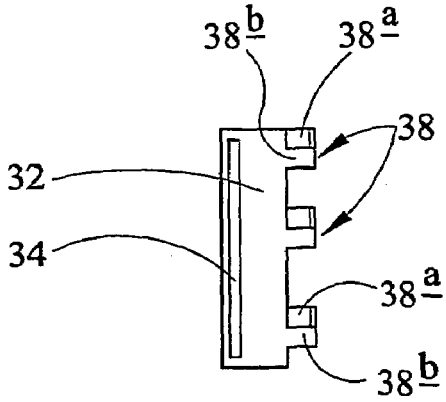
FIG. 5 is a view of one component of the barrier.

The fastening of FIGS. 3 to 5 comprises first and second components 30, 32, each of which is provided with a slot 34 through which the associated webbing is passed and secured, for example by stitching 36. The components 30, 32 each include a plurality of spaced knuckles 38, the spaces between the knuckles 38 being dimensioned to receive the knuckles 38 of the other of the components 30, 32. The knuckles 38 are shaped so as to define a passage 40, when in engagement with one another, through which a pin 42 extends to secure the components 30,32 and hence the lengths of webbing 20, 28, to one another. The components 30, 32 are of dimensions capable of passing through the slot 24 and being wound upon the spool 14.

To facilitate moulding of the components 30, 32 each of the knuckles 38 is in two-part form including a first part 38*a* defining one side of part of the passage 40, and a second part 38*b* defining the other side of part of the passage 40, the first and second parts 38*a*, 38*b* being axially spaced from one another. As a result of this design, when assembled a series of openings are formed through which the pin 42 is exposed.

As well as facilitating moulding, this design permits the pin 42 to be provided with radially extending protrusions 42*a* which are located to extend into the openings formed between the knuckle parts to secure the pin 42 against axial movement, thus reducing the risk of the pin 42 falling out of the passage 40, in use.

An alternative connector is illustrated in FIGS. 6 to 11 and comprises a first component 44 intended to be secured, in use, to the second length of webbing, and a second component 46 intended to be secured, in use, to the first length of webbing. The first and second components 44, 46 may be manufactured by injection moulding of a suitable flexible plastics material. Each component 44, 46 is shaped to define a pair of flanges 48 interconnected by a plurality of spaced teeth 50. At the point where the teeth 50 meet one of the flanges 48, projections 52 are provided, the projections 52 being locatable within recesses 54 formed at the point where the teeth 50 meet the other one of the flanges 48, upon each component 44, 46 being bent or folded about a line passing through the centre of each of the teeth 50.

The flanges 48 are each formed with openings 56 which, when the components 44, 46 are folded as mentioned above, generally align with one another and through which rivets can pass to secure the components 44, 46 to their respective lengths of webbing. If desired, the openings 56 may be positioned to pull the components 44, 46 into a slightly curved configuration.

The teeth 50 are positioned such that each tooth 50 of one of the components 44, 46 can be received between two adjacent ones of the teeth 50 of the other of the components 44, 46. Each tooth 50 is shaped to define, when folded, an opening. When the components 44, 46 are located adjacent one another with the teeth 50 inter-engaging, the openings align with one another to form a passage into which a third component in the form of a connecting pin 58 can be inserted to secure the first and second components 44, 46 to one another. As shown in FIG. 10, the pin 58 is provided with a series of small projections 60. The projections 60 are provided on two opposing sides of the pin 58 and are arranged in an alternating pattern. The projections 60 are receivable in recesses 62 provided in the components 44, 46, the location of the projections 60 in the recesses serving to restrict or resist accidental or unintentional removal of the pin 58 from the passage.

The assembled connector can be of flexible form, both by virtue of the material used in the manufacture thereof and also because the design of the connector allows a degree of articulation between the components 44, 46. The connector is further advantageous in that it is thin and thus can pass, in use, into the housing to be wound on to the spool.

In use, the housing 10 is secured, for example, to or within a part of a supermarket check-out. When the barrier is to be used, the webbing 20 is withdrawn from the housing 10 and the magnetic part 26 is secured to a component mounted upon part of an adjacent check-out. The action of moving the magnetic part 26 and pulling on the webbing 20 draws the webbing 20 from the spool 14, the spool 14 rotating and thus stressing the spring 18. Upon releasing the magnetic part 26 from the adjacent check-out, to remove the barrier, the spring 18 causes the spool 14 to rotate, retracting the webbing 20 into the housing 10. The length of the webbing 20 is chosen so that in normal use, the second length of webbing 28 remains completely within the housing 10. However, if it is desired to replace the first length of webbing 20, the webbing 20 is completely withdrawn from the housing 10, exposing the connection with the second length of webbing 28. The connection can then be released and a new, replacement length of webbing secured to the second length of webbing 28. The lengths of webbing can then be retracted into the housing 10 in the usual manner.

Conveniently, the second length of webbing 28 can be brightly coloured or marked in such a manner as to make it obvious that a point is being approached beyond which no further withdrawal of the webbing is possible. As a result, the risk of damage caused by attempting to continue to withdraw webbing from the housing when this is not possible is reduced.

Although one use of the invention is to allow replacement of lengths of webbing, a similar releasable coupling may be provided adjacent the free end 22 of the webbing 20 to allow replacement of the magnetic part 26, for example by an alterative securing device. The releasable coupling may also be used to allow the introduction of an additional length of webbing or to allow the replacement of a relatively short webbing with a longer length. When the length of the webbing is changed, it will be appreciated that the design of the housing, spool and/or spring may be such that complete retraction of the webbing is not possible.

The description and drawings herein are of a device intended to be mounted upon a supermarket check-out. It will be appreciated, however, that the invention is also suitable for use in other applications, for example in pole mounted devices for use as, for example, queue management systems. Other applications are also possible, for example the invention may also be used in seat belts, for example retractable seat belts for use in vehicles, or in luggage straps or load or ratchet straps, for example for use in securing loads in position on or in lorries or the like. It will be appreciated that in some of these applications different materials may be needed to achieve the desired mechanical properties. It will further be appreciated that a number of modifications can be made to the device within the scope of the invention.

The invention claimed is:

1. A retractable webbing system comprising:

a. a retraction apparatus, the retraction apparatus comprising a rotatable spool which is biased by a spring;

b. a flexible connection member comprising a length of webbing;

c. a second length of webbing, wherein the flexible connection member connects the second length of webbing to the retraction apparatus;

d. a releasable connector interconnecting the flexible connection member and the second length of webbing, wherein the releasable connector comprises:

(i) first and second inter-engageable components securable, in use, to the flexible connection member and to the second length of webbing, respectively, the inter-engageable components defining a plurality of spaced teeth, at least some of the teeth of one of the components being receivable between the teeth of the other component, the teeth each defining an opening, the openings aligning, in use, to form a passage, (ii) securing means to secure the inter-engageable components to one another, the securing means comprising a pin which is received, in use, in the passage, and (iii) a detent arrangement for securing the pin in position, the detent arrangement comprising a plurality of projections provided on the pin and receivable with recesses formed in the inter-engageable components; and e. a housing for the retraction apparatus, and wherein the flexible connection member is of sufficient length that when the webbing is fully withdrawn from the retraction apparatus, the releasable connector is located outside the housing.

2. A retractable webbing system comprising a retraction apparatus, a flexible connection member, a length of webbing, wherein the flexible connection member connects the length of webbing to the retraction apparatus, a releaseable connector comprising first and second inter-engageable components interconnecting the flexible connection member and the length of webbing, respectively, the inter-engageable components defining a plurality of spaced teeth, at least some of the teeth of one of the inter-engageable components being receivable between the teeth of the other inter-engageable component, the teeth each defining an opening, the openings aligning, in use, to form a passage within which a pin forming securing means can be received to secure the inter-engageable components to one another.

3. A system according to claim 2, further comprising a detent arrangement for securing the pin in position.

4. A system according to claim 3, wherein the detent arrangement comprises a plurality of projections provided on the pin and receivable within recesses formed in the inter-engageable components.

5. A system according to claim 2, wherein the flexible connection member comprises a second length of webbing.

6. A system according to claim 2, further comprising a housing for the retraction apparatus, the flexible connection member being of sufficient length that when the webbing is fully withdrawn from the retraction apparatus, the releasable connector is located outside of the housing.

7. A system according to claim 2, wherein the retraction apparatus comprises a rotatable spool.

8. A system according to claim 7, wherein the rotatable spool is biased by a spring.

* * * * *